US009498101B2

(12) United States Patent
Chun et al.

(10) Patent No.: US 9,498,101 B2
(45) Date of Patent: Nov. 22, 2016

(54) DISHWASHER USING OSCILLATORY FLOW GENERATED FROM THERMOACOUSTIC EFFECT

(71) Applicant: JEJU NATIONAL UNIVERSITY INDUSTRY-ACADEMIC COOPERATION FOUNDATION, Jeju-si, Jeju-do (KR)

(72) Inventors: Wongee Chun, Jeju-si (KR); Seungjin Oh, Jeju-si (KR); Namjin Kim, Jeju-si (KR); Youncheol Park, Jeju-si (KR); Yeongmin Kim, Seogwipo-si (KR); Kuan Chen, Salt Lake City, UT (US)

(73) Assignee: Jeju National University Industry-Academic Cooperation Foundation, Jeju-si, Jeju-do (KR)

( * ) Notice: Subject to any disclaimer, the term of this patent is extended or adjusted under 35 U.S.C. 154(b) by 94 days.

(21) Appl. No.: 14/471,792

(22) Filed: Aug. 28, 2014

(65) Prior Publication Data

US 2016/0058265 A1 Mar. 3, 2016

(30) Foreign Application Priority Data

Aug. 28, 2014 (KR) ..... 10-2014-0113018

(51) Int. Cl.
*A47L 15/42* (2006.01)

(52) U.S. Cl.
CPC ..... *A47L 15/4214* (2013.01)

(58) Field of Classification Search
CPC ..... A23C 3/02; A47L 15/23; A47L 15/4221; A47L 15/4214; B08B 3/045
See application file for complete search history.

(56) References Cited

U.S. PATENT DOCUMENTS

| | | | | |
|---|---|---|---|---|
| 3,854,998 | A * | 12/1974 | Jacobs | A47L 15/16 134/1 |
| 5,218,980 | A * | 6/1993 | Evans | A47L 15/0002 134/1 |
| 2005/0268668 | A1* | 12/2005 | Miyauti | A47L 15/0002 68/3 R |
| 2006/0102757 | A1* | 5/2006 | Johnson | B05B 1/34 239/590.3 |
| 2007/0056610 | A1* | 3/2007 | Lee | A47J 43/24 134/25.3 |
| 2007/0251549 | A1* | 11/2007 | Heiligenmann | A47L 15/0015 134/31 |
| 2007/0277855 | A1* | 12/2007 | DiPanni | A23N 12/02 134/25.3 |
| 2011/0073670 | A1* | 3/2011 | Johnson | B05B 1/34 239/18 |
| 2011/0203620 | A1* | 8/2011 | Ulger | A47L 15/424 134/184 |

* cited by examiner

*Primary Examiner* — Michael Barr
*Assistant Examiner* — Benjamin L Osterhout
(74) *Attorney, Agent, or Firm* — Novick, Kim & Lee, PLLC; Jae Youn Kim

(57) ABSTRACT

Disclosed herein is a dishwasher using oscillatory flow generated from thermoacoustic effect. The dishwasher is configured such that thermoacoustic waves having high amplitude are generated from solar energy rather than electric energy, wherein the thermoacoustic waves make oscillating waves be directly transmitted to an air column and a water column formed in a closed end of a dishwashing pipeline. In this way, high-quality energy can be directly applied to washing water, whereby energy loss can be minimized, and the washing efficiency can be markedly increased.

2 Claims, 3 Drawing Sheets

DISHWASHER USING OSCILLATORY FLOW GENERATED FROM THERMOACOUSTIC EFFECT

BACKGROUND OF THE INVENTION

1. Field of the Invention

The present invention relates to a dishwasher using oscillatory flow generated from thermoacoustic effect that is configured such that thermoacoustic waves having high amplitude are generated from solar energy rather than electric energy, wherein the thermoacoustic waves make oscillating waves be directly transmitted to an air column and a water column formed in a closed end of a dishwashing pipeline. In this way, high-quality energy can be directly applied to washing water, whereby energy loss can be minimized, and the washing efficiency can be markedly increased.

2. Description of the Related Art

Generally, conventional thermoacoustic wave generators using solar light are configured such that a porous stack (solid block) is disposed in a transparent tube closed on one end thereof and thermoacoustic waves are generated by heating a portion thereof adjacent to the closed end of the transparent tube.

However, in conventional thermoacoustic wave generators, to generate high-frequency thermoacoustic waves, the size of the transparent tube must be reduced inversely proportional to the frequency of thermoacoustic waves, and a high thermal gradient between both ends of the porous stack must be maintained. Therefore, in practice it is very difficult to embody such conventional thermoacoustic wave generators. Referring to the result of research so far, it has been reported that the University of Utah, USA succeeded in producing a maximum acoustic wave of 3 kHz via this conventional technique.

In other words, it is no exaggeration to say that it is almost impossible to produce thermoacoustic waves in an ultrasonic wave range of 18 kHz or more using the above conventional technique.

Furthermore, research on generating thermoacoustic waves has focused on generating compression waves via a process of heating a very small micro-sized structure by momentarily applying Joule's heat resulting from electric energy to the structure and then cooling the structure. This process is repeated so that air surrounding the structure is expanded and cooled.

In an effort to overcome the problems of the conventional techniques pertaining to thermoacoustic wave generators, the applicant of the present invention proposed a thin metal plate membrane structure in Korean Patent Registration No. 10-1207380.

However, the technique of No. 10-1207380 is problematic in that the efficiency in producing high frequency is comparatively low because some solar light transmitted through a hole is lost in the air before it reaches the membrane structure. In addition, the size of a light interrupter must be greatly increased depending on the size of the thin metal plate. Thus, it is substantially difficult to commercialize the technique.

Therefore, there still is a problem in that it is difficult to substantially apply the conventional acoustic wave generator to various related industrial fields (for example, a dishwasher-related field, etc.)

SUMMARY OF THE INVENTION

Accordingly, the present invention has been made keeping in mind the above problems occurring in the prior art, and an object of the present invention is to provide a dishwasher using oscillatory flow generated from thermoacoustic effect that is configured such that thermoacoustic waves having high amplitude are generated from solar energy rather than electric energy, wherein the thermoacoustic waves make oscillating waves be directly transmitted to an air column and a water column formed in a closed end of a dishwashing pipeline. In this way, high-quality energy can be directly applied to washing water, whereby energy loss can be minimized, and the washing efficiency can be markedly increased.

Another object of the present invention is to provide a dishwasher including a high-frequency acoustic wave generator configured such that when a pulse beam formed by a light interrupter is directly radiated onto a porous material having a woven net or steel scrubber shape, thin wires of the porous material repeatedly rapidly thermally-expand and contract, whereby air in the space between the wires is momentarily heated and cooled, and the expansion and contraction of air is directly transmitted to an air column formed just adjacent to the porous material. By virtue of the above structure, the efficiency of the generator is markedly improved compared to the conventional technique, and the productivity is also greatly enhanced.

A further object of the present invention is to provide a dishwasher including the high-frequency acoustic wave generator configured to generate high-frequency (ultrasonic) waves from obtained acoustic waves and provide the acoustic waves to a variety of industrial fields including fields pertaining to sterilization, washing, etc.

In order to accomplish the above object, the present invention provides a dishwasher using oscillatory flow generated from thermoacoustic effect, including: an acoustic wave generator and a wash module. The acoustic wave generator includes: a focusing tube focusing solar light collected by a solar tracking reflector to form high-density light and emitting the focused solar light; a light interrupter including a circular disk and a rotating drive unit, the circular disk having a plurality of holes arranged at positions spaced apart from each other at regular intervals in a circumferential direction around the rotating drive unit so that solar light emitted from the focusing tube passes through the holes and thus is intermittently emitted, and a pulse beam is formed by intermittent solar light that has passed through one of the holes of the light interrupter; a housing body having a hollow tubular socket structure made of aluminum, the housing body including: an open input end through which the pulse beam enters the housing body; a space formed behind the input end, the space forming an air column; and an open output end provided behind the space; a glass cover coupled to the open input end of the housing body; a porous material provided on a rear surface of the glass cover, the porous material including a wire configured such that when the wire is thermally-expanded by the pulse beam and thermally-contracted (repeatedly deformed), the air column in the space contracts and expands, thus generating sound; and a wave guide coupled to the open output end of the housing body, the wave guide transmitting the generated sound to a desired place of use. The wash module is connected to the wave guide of the acoustic wave generator and includes: a tubular closed end configured such that when an air column vibrates, vibration having a predetermined amplitude is directly applied to a water column contained in the tubular closed end; a wash chamber connected to an open side of the closed end, the wash chamber containing washing water therein; and a transfer pipe provided on a predetermined portion of the wash chamber and connected to a desired dish washing tank.

The wash module may further include at a predetermined position a heat exchanger collecting waste heat generated from the wave guide of the acoustic wave generator and supplying the waste heat to the wash chamber.

In an embodiment, the input end of the housing body may have a junction surface provided with a stepped protrusion. A surface of the porous material may be formed to correspond to the junction surface. The diameter of the space having the air column may be ⅓ to ⅕ of a diameter of the input end.

The porous material may be disposed in the space of the housing body.

Preferably, the porous material is made of aluminum wires each of which has a diameter ranging from 0.1 μm to 1 μm and is superior in a light absorption coefficient, a thermal expansion coefficient and heat radiation performance.

Furthermore, the input end of the housing body has a smaller diameter than that of a cross-sectional area of a solar light beam passing through one of the holes of the light interrupter, whereby the thermal responsiveness can be maximized.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Figure 1:
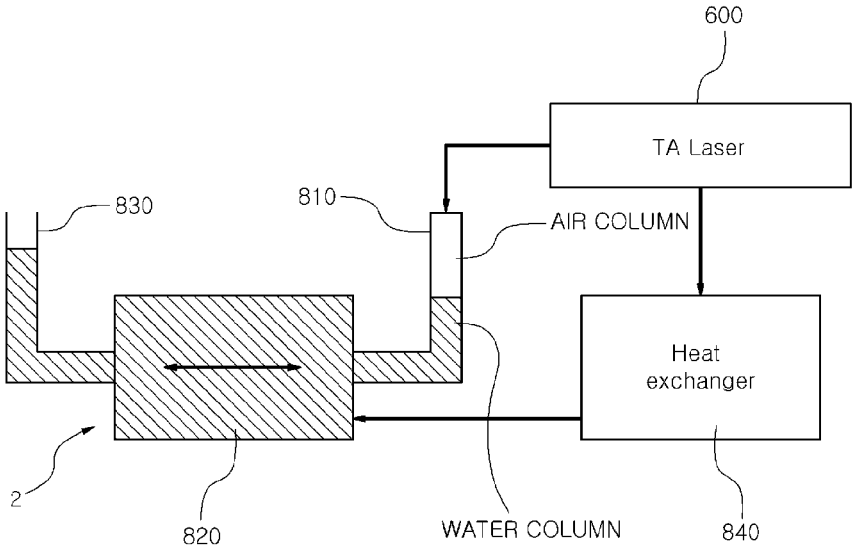
FIG. 1 is a schematic view illustrating a dishwasher according to the present invention.
Figure 2:
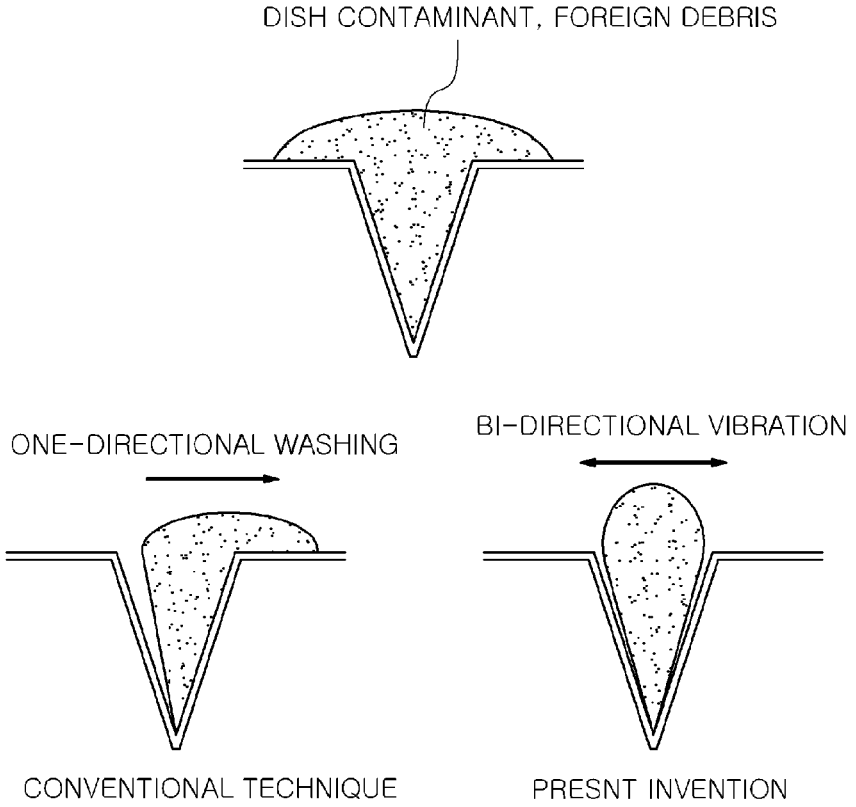
FIG. 2 is a view comparing a process of removing a foreign debris or contaminant from a dish using the dishwasher with that of the conventional technique.
Figure 3:
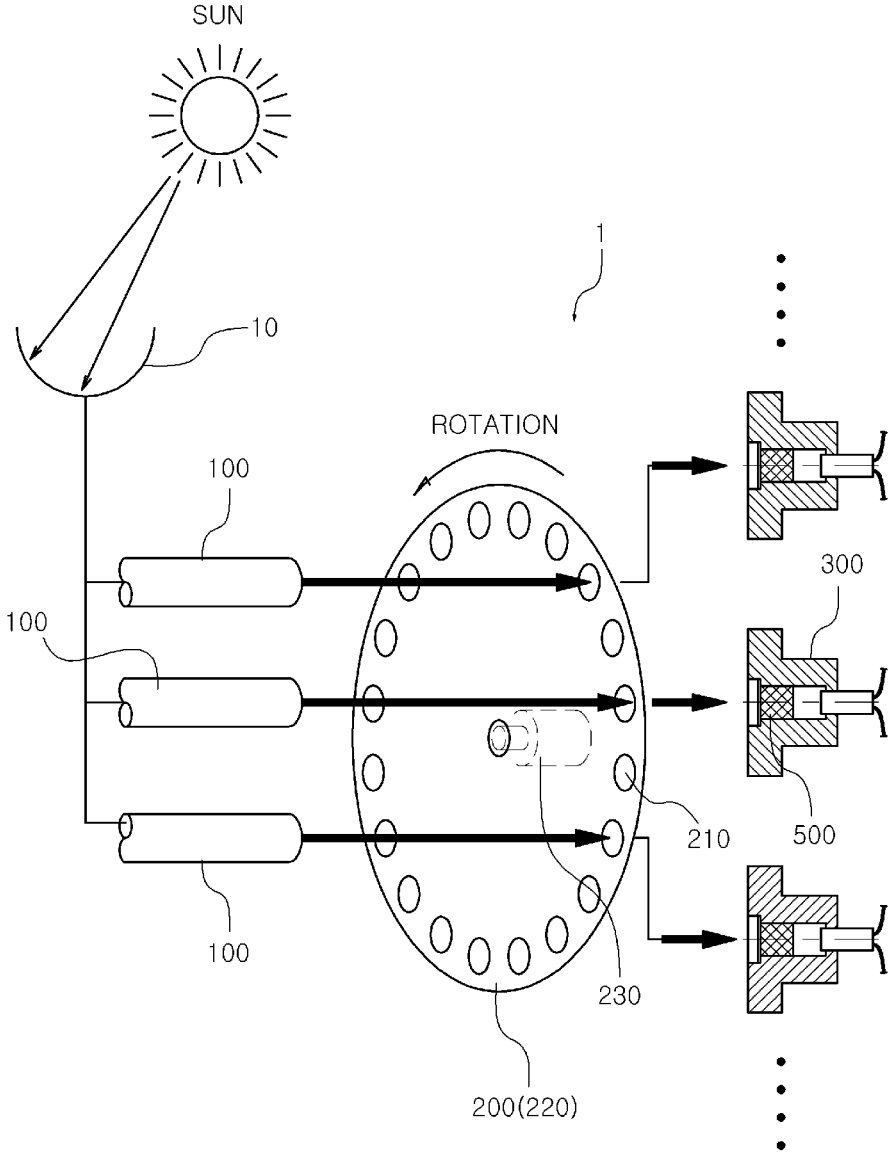
FIG. 3 is a schematic view showing the application of an acoustic wave generator according to the present invention.
Figure 4:
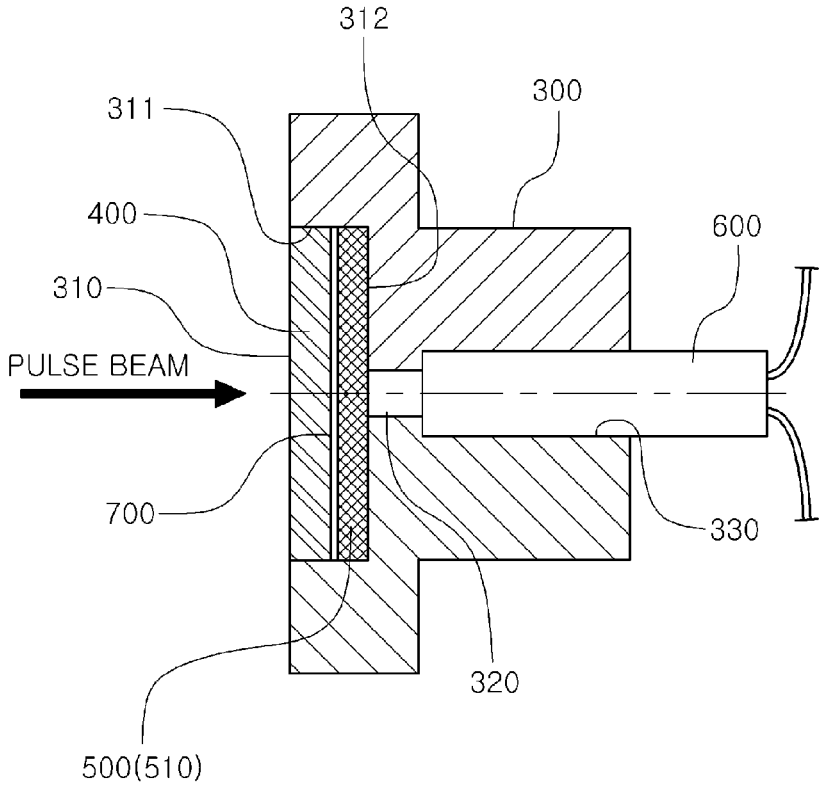
FIG. 4 is a sectional view illustrating an embodiment of the acoustic wave generator according to the present invention.
Figure 5:
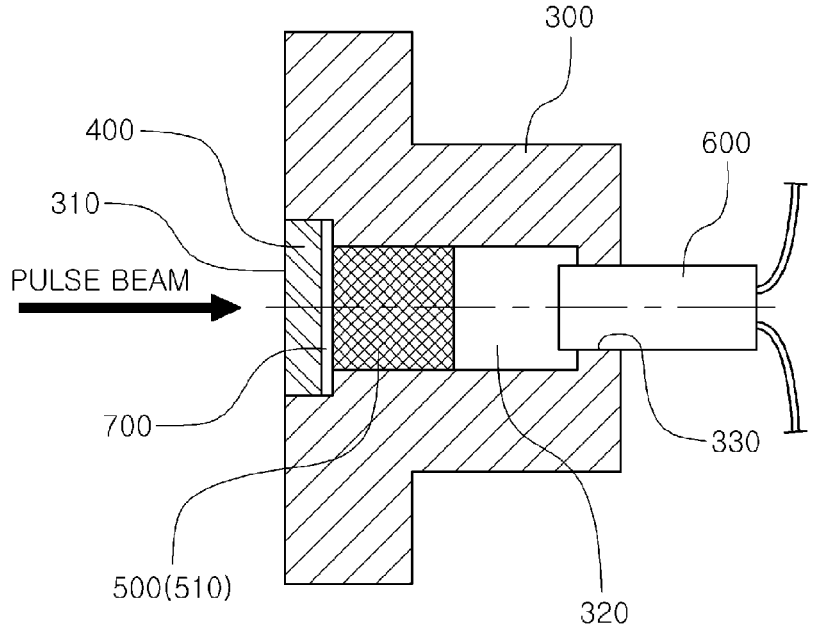
FIG. 5 is a sectional view illustrating another embodiment of the acoustic wave generator according to the present invention.

Hereinafter, the present invention will be described in detail with reference to the attached drawings.

As shown in FIGS. 1 through 5, the present invention includes an acoustic wave generator 1 and a wash module 2.

The acoustic wave generator 1 according to the present invention includes a focusing tube 100, a light interrupter 200, a housing body 300, a glass cover 400, a porous material 500 and a wave guide 600.

The wash module 2 is connected to the wave guide 600 of the acoustic wave generator 1 and includes a tubular closed end 810 configured such that when an air column vibrates, vibration having a predetermined amplitude is directly applied to a water column contained in the tubular closed end 810. The wash module 2 further includes a wash chamber 820 that is connected to an open side of the closed end 810 and contains washing water therein, and a transfer pipe 830 that is provided on a predetermined portion of the wash chamber 820 and connected to a desired dish washing tank. Preferably, the closed end is a transparent pipe made of glass.

The wash module 2 further includes at a predetermined position a heat exchanger 840 that collects waste heat generated from the wave guide 600 of the acoustic wave generator 1 and supplies the waste heat to the wash chamber 820.

That is, the heat exchanger 840 includes a predetermined position thereof a conductor configured such that heat generated from the wave guide is collected via a waste heat recovery cycle and then transferred to the wash chamber in a convection or conduction manner through a thermal medium, thus enhancing the washing efficiency.

The focusing tube 100 focuses solar light collected by a solar tracking reflector to form high-density light and emits the focused light. The light interrupter 200 includes a circular disk 220 and a rotating drive unit 230. The circular disk 220 has a plurality of holes 210 that are arranged at positions spaced apart from each other at regular intervals in the circumferential direction around the rotating drive unit 230. Solar light emitted from the focusing tube 100 passes through the holes 210 so that the solar light is intermittently applied to the housing body 300.

As shown in FIG. 1, the holes 210 formed at regular intervals around the perimeter of the circular disk 220 of the light interrupter 200 cause light to intermittently pass through the circular disk 220, thus making a pulse beam. Depending on the number of holes 210 and the RPM of the circular disk 220, the frequency of the pulse beam is determined.

The housing body 300 is made of aluminum having high thermal responsiveness. A pulse beam formed by intermittently passing solar light through the holes 210 of the light interrupter 200 enters an open input end 310 of the housing body 300 having a hollow pipe shape. A space 320 forming an air column is formed behind the input end 310. An open output end 330 is formed behind the space 320.

The glass cover 400 is coupled to the open input end 310 of the housing body 300.

The porous material 500 is coupled to a rear surface of the glass cover 400. When wires 510 of the porous material 500 are thermally-expanded by pulse beams and thermally-contracted (repeatedly deformed), the air column in the space 320 also contracts and expands, thus generating sound.

A sealer 700 for airtightness is interposed between the glass cover 400 and the porous material 500. The reason for this is to maintain the space in the housing body 300 in a vacuum so that the thermal deformation of the wires 510 can rapidly and reliably conducted.

The wave guide 600 is coupled to the open output end of the housing body 300 and configured to transmit the generated sound to a desired place of use. Preferably, the wave guide comprises a microphone.

In an embodiment, the input end 310 of the housing body 300 has a junction surface 321 with a stepped protrusion 311. A surface of the porous material 500 is formed to correspond to the junction surface 312. The diameter of the space 320 having the air column is ⅓ to ⅕ of that of the input end 310.

That is, in the porous material 500 having a relatively large area corresponding to that of the junction surface of the input end 310, thermal deformation of contraction or expansion is comparatively large. On the other hand, thermal deformation of the space just adjacent to the porous material 500 is relatively small. Therefore, the amplitude of the air column can be comparatively large, whereby high frequency and high decibel of sound can be generated.

In another embodiment, the porous material 500 may be disposed in the space 320 of the housing body 300.

This embodiment forms a direct transmission structure between the porous material 500 and the air column, thus minimizing loss in the transmission structure.

Preferably, the porous material 500 is made of aluminum wires 510 each of which has a diameter ranging from 0.1 μm to 1 μm and is superior in a light absorption coefficient, a thermal expansion coefficient and heat radiation performance.

Furthermore, the input end 310 of the housing body 300 has a smaller diameter than that of a cross-sectional area of a solar light beam passing through one of the holes 210 of the light interrupter, whereby the thermal responsiveness can be maximized.

Preferably, the porous material 500 is coated with black to absorb as much solar light as possible.

Furthermore, the focusing tube 100 according to the present invention has a structure divided from the reflector into a plurality of focusing tubes 100, preferably, the number of which corresponds to the number of holes of the light interrupter 200. Connected to a converter, terminals (each of which includes the housing body, the glass cover, the porous material, the wave guide and the sealer) respectively matching with the focusing tubes are disposed at a side opposite to the focusing tubes based on the light interrupter 200. A variety of wavelengths of light caused due to the characteristics of solar light are synchronized (integrated) with each other by the converter so that the output power is collected.

In other words, although electric energy generally has a single laser pulse wavelength, solar light has a variety of wavelengths of rays including infrared rays, ultraviolet rays, etc. Given this, when solar light is input to the terminals divided into several parts, a variety of wavelengths of light are collected by the converter, whereby the output power can be increased.

As described above, a dishwasher using oscillatory flow generated from thermoacoustic effect according to the present invention is configured such that when a pulse beam formed by a light interrupter is directly radiated onto a porous material having a woven net or steel scrubber shape, thin wires of the porous material repeatedly rapidly thermally-expand and contract, whereby air in the space between the wires is momentarily heated and cooled, and the expansion and contraction of air is directly transmitted to an air column formed just adjacent to the porous material. By virtue of the above structure, the efficiency of the apparatus according to the present invention is markedly improved compared to the conventional technique, and the productivity is also greatly enhanced.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A dishwasher using oscillatory flow generated from thermoacoustic effect, comprising:

an acoustic wave generator comprising:

a focusing tube for focusing solar light collected by a solar tracking reflector to emit the focused solar light;

a light interrupter including a circular disk and a rotating drive unit, the circular disk having a plurality of holes arranged at positions spaced apart from each other at regular intervals in a circumferential direction around the rotating drive unit so that the solar light emitted from the focusing tube passes through the holes and thus is intermittently emitted, and a pulse beam is formed by the intermittent solar light that has passed through one of the holes of the light interrupter;

a housing body having a hollow tubular socket structure, the housing body including: an open input end through which the pulse beam enters the housing body; a space disposed behind the input end, the space defining a first air column; and an open output end disposed behind the space;

a glass cover coupled to the open input end of the housing body (300);

a porous material disposed on a rear surface of the glass cover, the porous material including a wire configured such that when the wire is thermally-expanded by the pulse beam and thermally-contracted, the first air column in the space contracts and expands, thus generating sound; and a wave guide coupled to the open output end of the housing body, the wave guide transmitting the generated sound to a desired place of use; and a wash module connected to the wave guide of the acoustic wave generator, the wash module comprising:

a tubular closed end pipe including a second air column and a water column, and configured such that when the second air column vibrates, vibration is directly applied to the water column;

a wash chamber connected to an open side of the closed end pipe, the wash chamber containing washing water therein; and a transfer pipe connected to the wash chamber and connected to a desired dish washing tank.

2. The dishwasher as set forth in claim 1, wherein the wash module further comprises a heat exchanger configured for collecting waste heat generated from the wave guide of the acoustic wave generator and supplying the waste heat to the wash chamber.

* * * * *